US008814583B2

(12) United States Patent
Naito

(10) Patent No.: US 8,814,583 B2
(45) Date of Patent: Aug. 26, 2014

(54) USB CONNECTOR

(71) Applicant: Japan Aviation Electronics Ind., Ltd., Tokyo (JP)

(72) Inventor: Takeharu Naito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 3 days.

(21) Appl. No.: 13/779,702

(22) Filed: Feb. 27, 2013

(65) Prior Publication Data

US 2013/0225010 A1 Aug. 29, 2013

(30) Foreign Application Priority Data

Feb. 29, 2012 (JP) ..... 2012-043534

(51) Int. Cl.
*H01R 24/00* (2011.01)

(52) U.S. Cl.
USPC ..... 439/188; 439/660

(58) Field of Classification Search
USPC ..... 439/660, 676, 188
See application file for complete search history.

(56) References Cited

U.S. PATENT DOCUMENTS

| | | | | |
|---|---|---|---|---|
| 7,537,483 | B2 * | 5/2009 | Lin et al. | 439/607.01 |
| 7,938,659 | B1 * | 5/2011 | Zhu et al. | 439/218 |
| 8,079,879 | B2 * | 12/2011 | Chiang | 439/660 |
| 8,574,011 | B2 * | 11/2013 | Shih | 439/660 |
| 2007/0173121 | A1 * | 7/2007 | Chiang | 439/609 |
| 2008/0261448 | A1 * | 10/2008 | Yi et al. | 439/607 |
| 2009/0061671 | A1 * | 3/2009 | Qin et al. | 439/188 |
| 2009/0111330 | A1 * | 4/2009 | Lin et al. | 439/638 |
| 2011/0092107 | A1 * | 4/2011 | Nomiyama et al. | 439/660 |
| 2011/0281449 | A1 * | 11/2011 | Ko | 439/188 |
| 2012/0052709 | A1 * | 3/2012 | Ko | 439/345 |

FOREIGN PATENT DOCUMENTS

| | | |
|---|---|---|
| JP | 2003-197302 A | 7/2003 |
| JP | 2005-242476 A | 9/2005 |
| JP | 3172188 U | 12/2011 |

* cited by examiner

*Primary Examiner* — Briggitte R Hammond
(74) *Attorney, Agent, or Firm* — Holtz Holtz Goodman & Chick PC

(57) ABSTRACT

A USB connector comprises a special USB plug and a USB receptacle mateable with the special USB plug. The special USB plug has a plug ground contact and a plug contact portion as a part of the plug ground contact. The USB receptacle has a plurality of contacts including a ground contact, a detector and a holding member. Each of the contacts has a contact point. Especially the ground contacts has the contact point configured to be brought into contact with the plug ground contact while the detector has a detecting portion configured to be brought into contact with the plug contact portion. The holding member has a plate portion formed with a principal surface. The holding member holds the contacts so that the contact points project from the principal surface of the plate portion while holding the detector so that the detecting portion projects from the principal surface of the plate portion. A distance between the detecting portion and the contact point of the ground contact is smaller than a distance between the detecting portion and the contact point of the contact other than the ground contact.

5 Claims, 4 Drawing Sheets

USB CONNECTOR

CROSS REFERENCE TO RELATED APPLICATIONS

An Applicant claims priority under 35 U.S.C. §119 of Japanese Patent Application No. JP2012-043534 filed Feb. 29, 2012.

BACKGROUND OF THE INVENTION

This invention relates to a universal serial bus (USB) connector comprising a special USB plug and a USB receptacle selectively mateable with at least two types of USB plugs including the special USB plug. The USB receptacle according to this invention has a detecting structure for identifying the type of the USB plug mated therewith.

Recently, a USB receptacle connectable to a standard USB plug (i.e. a USB plug) compliant with a USB standard is required to be also connectable to a special USB plug (i.e. another USB plug) configured by modifying the standard USB plug. Moreover, the USB receptacle connected to the special USB plug is required to work differently from the USB receptacle connected to the standard USB plug.

For example, when the USB receptacle supplies a bus-power to a device connected with the USB receptacle via the USB plug, it is preferred to supply different power according to the type of the connected device. More specifically, if the USB receptacle is connected with a device operable with a small power, it is necessary to supply such a small power that the device is not damaged. On the contrary, if the USB receptacle is connected with a device (for example, an external hard disk drive) which needs a large power, it is necessary to supply the large power. In other words, the USB receptacle is required to supply a proper power according to the connected device. If the USB receptacle is able to identify the mated USB plug, the proper power may be supplied by connecting the device via different USB plug according to the power to be supplied.

For example, a USB receptacle and a USB plug mateable with each other are disclosed in JP-A 2005-242476 (Patent Document 1), JP-U 3172188 (Patent Document 2) and JP-A 2003-197302 (Patent Document 3), contents of which are incorporated herein by reference.

Each of the USB receptacles disclosed in Patent Document 1 and Patent Document 2 is provided with a detecting structure for detecting whether the USB plug is connected or not. Each of the USB receptacle and the USB plug disclosed in Patent Document 3 has an additional power contact in addition to contacts (for example, signal contacts) compliant with the USB standard. The additional power contact is used for electric power transmission to a hard disk drive, etc.

However, the aforementioned detecting structure is configured without considering a case where a plurality of types of the USB plugs are selectively mateable. More specifically, the aforementioned USB receptacle with the detecting structure is not configured to identify the type of the mated USB plug. Moreover, the USB receptacle with the detecting structure has no additional power contact.

According to Patent Document 3, the power contact (i.e. the additional power contact) of the USB receptacle is brought into contact with an edge (i.e. a side edge) of a power contact of the USB plug. Accordingly, a contact area between the power contacts is smaller than a contact area between the signal contacts. In other words, the contact area between the power contacts is very small so that it is difficult to transmit the power properly.

As can be seen from the above description, it is required a technique to identify the type of the mated USB plug. Moreover, it is required a more practical technique to properly supply the power to the connected device.

SUMMARY OF THE INVENTION

It is therefore an object of the present invention to provide a connector which comprises a special USB Plug, and a USB receptacle selectively mateable with USB plugs including a standard USB plug and the special USB plug. Especially, the USB receptacle provided by this invention is able to not only detect that the USB plug is mated, but also identify whether the mated USB plug is the standard USB plug or the special USB plug. Moreover, the USB receptacle provided by this invention has a practical structure for supplying a power.

One aspect of the present invention provides a USB connector comprising a special USB plug and a USB receptacle. The special USB plug has a plug ground contact and a plug contact portion which is not provided in a standard USB plug compliant with a USB standard. The plug ground contact has a width wider than another width compliant with a 2.0 version of the USB standard. The plug contact portion is a part of the plug ground contact. The USB receptacle is selectively mateable with and removable from the standard USB plug and the special USB plug along a predetermined direction. The USB receptacle has a plurality of contacts compliant with the 2.0 version of the USB standard, a detector and a holding member. The contacts include a ground contact which is connected to the plug ground contact under a mated state where the USB receptacle is mated with the special USB plug. Each of the contacts has a contact point. The detector has a detecting portion which is brought into contact with the plug contact portion under the mated state. The holding member has a plate portion formed with a principal surface. The holding member arranges and holds the contacts in a width direction perpendicular to the predetermined direction so that the contact point of the contact projects from the principal surface of the plate portion. The holding member holds the detector so that the detecting portion projects from the principal surface of the plate portion. A distance between the detecting portion and the contact point of the ground contact is smaller than a distance between the detecting portion and the contact point of the contact other than the ground contact.

An appreciation of the objectives of the present invention and a more complete understanding of its structure may be had by studying the following description of the preferred embodiment and by referring to the accompanying drawings.

Figure 1:
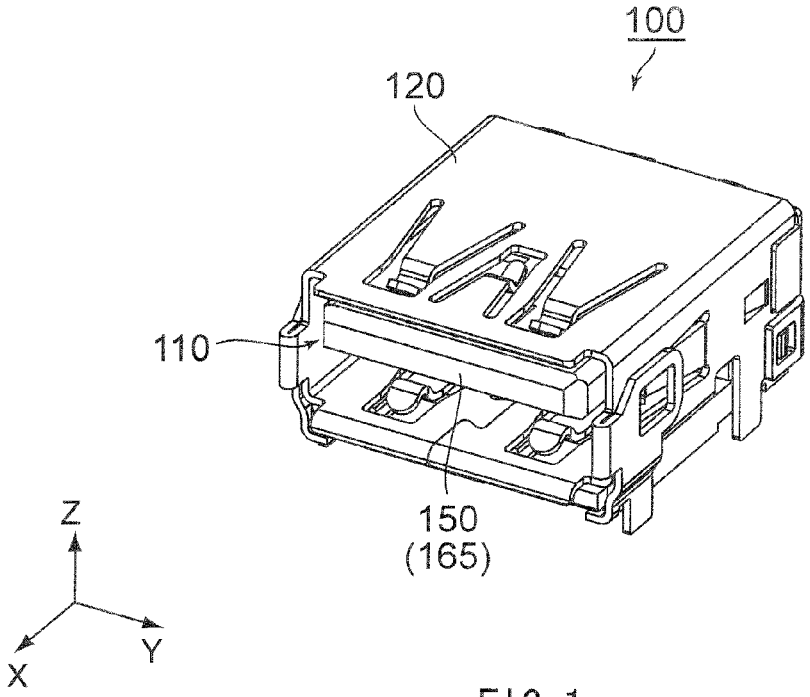
FIG. 1 is a perspective view showing a USB receptacle according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As can be seen from FIGS. 1 to 7, a USB connector according to an embodiment of the present invention comprises a USB receptacle 100 and a special USB plug 500. The USB receptacle 100 (see FIGS. 1 and 2) is selectively mateable with and removable from a plurality types of USB plugs including at least a standard USB plug (not shown) and the special USB plug 500 (see FIGS. 5 and 6) along the X-direction (predetermined direction). The USB receptacle 100 has a mating end mateable with the USB plug in the X-direction. The mating end is the positive X-side end of the USB receptacle 100 in the X-direction. In the following description, the mating end side (i.e. the positive X-side) of the USB receptacle 100 in the X-direction is referred to as a "front side" while a side (i.e. the negative X-side) opposite to the mating end side is referred to as a "rear side". Accordingly, the positive X-direction extends "forward" while the negative X-direction extends "rearward". The USB receptacle 100 according to the present embodiment is mateable with the USB plug inserted thereinto along the negative X-direction (i.e. rearward). In other words, an insert direction along which the USB plug is inserted into the USB receptacle 100 is the negative X-direction while a remove direction along which the USB plug is removed from the USB receptacle 100 is the positive X-direction.

Figure 5:
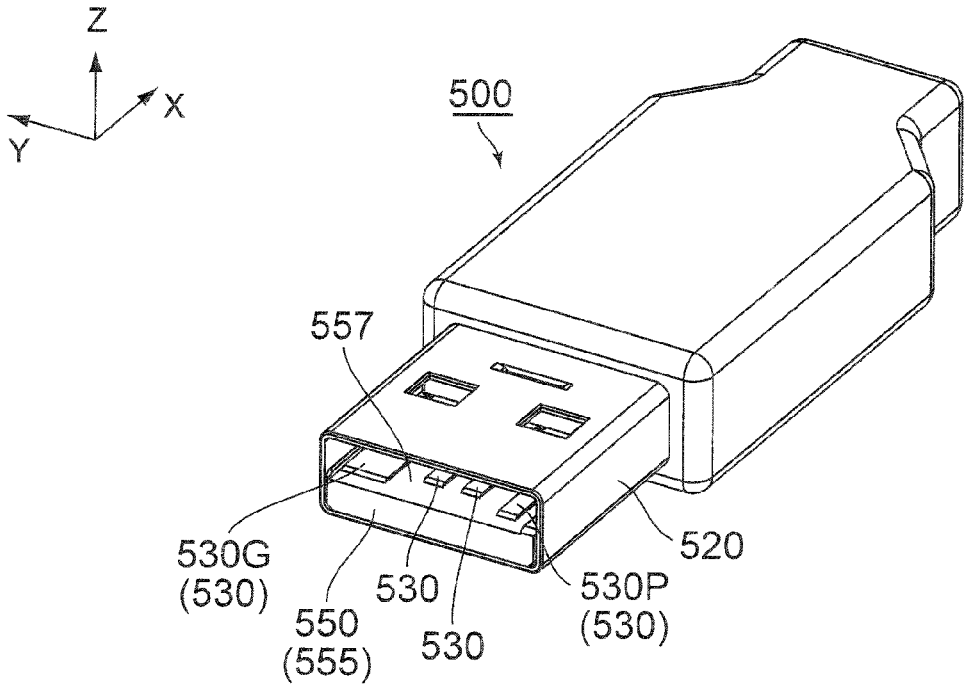
FIG. 5 is a perspective view showing a special USB plug according to the embodiment of the present invention.
Figure 6:
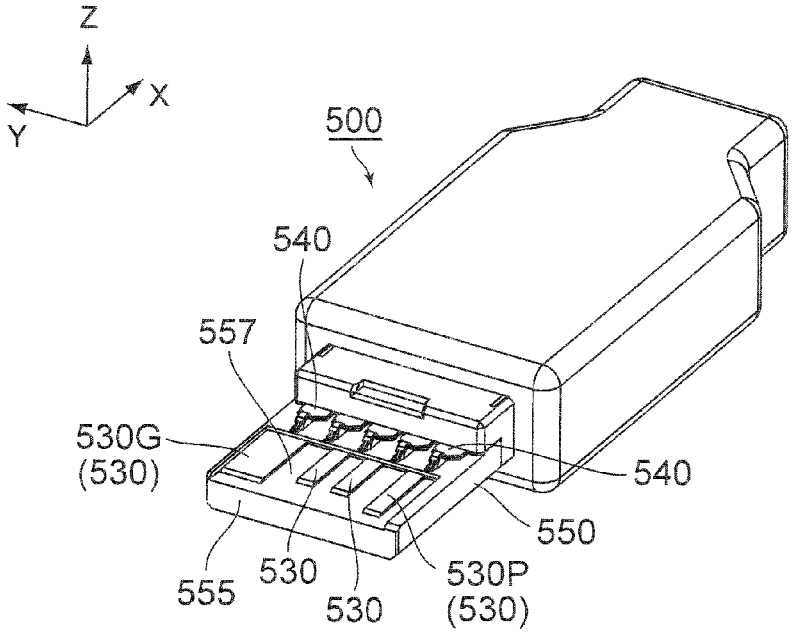
FIG. 6 is another perspective view showing the special USB plug of FIG. 5, wherein a shell of the special USB plug is not illustrated.

The standard USB plug (not shown) according to the present embodiment is compliant with a USB standard. For example, the standard USB plug is a USB 2.0 plug (i.e. a USB plug) having a structure compliant with a USB 2.0 standard (i.e. a 2.0 version of the USB standard), or a USB 3.0 plug (i.e. another USB plug) having a structure compliant with a USB 3.0 standard (i.e. a 3.0 version of the USB standard). As shown in FIGS. 5 and 6, the special USB plug 500 according to the present embodiment is a modification of the USB 3.0 plug. However, the special USB plug 500 may be a modification of the standard USB plug other than the USB 3.0 plug. Thus, the special USB plug 500 is compatible with the standard USB plug while not fully compliant with the USB standard. As described later, the special USB plug 500 has a plug contact portion which is not provided in the standard USB plug.

As shown in FIGS. 5 and 6, the special USB plug 500 has a shell 520 made of a metal, a plurality of contacts 530 for USB 2.0 connection each made of a conductive material, a plurality of contacts 540 for USB 3.0 connection each made of a conductive material and a holding member 550 made of an insulating material. The holding member 550 holds the contacts 530 and the contacts 540. In detail, the holding member 550 has a plate portion 555 formed with a principal surface 557. The contacts 530 and the contacts 540 are held by the holding member 550 so as to be partially exposed on the principal surface 557 of the plate portion 555. The shell 520 encloses the holding member 550, which holds the contacts 530 and the contacts 540, in the YZ-plane perpendicular to the X-direction.

As shown in FIG. 6, the contacts 530 include a power contact 530P and a plug ground contact 530G corresponding to a power contact and a ground contact of the USB 2.0 plug (not shown), respectively. In detail, the power contact 530P has the same shape and structure as the power contact of the USB 2.0 plug. Furthermore, the power contact 530P is provided at the same position as the power contact of the USB 2.0 plug. The plug ground contact 530G is a little different from the ground contact of the USB 2.0 plug. For example, the plug ground contact 530G is wider than the ground contact of the USB 2.0 plug in the Y-direction (width direction). In other words, the plug ground contact 530G has a width (i.e. a size in the Y-direction) wider than a width of the ground contact of the USB 2.0 plug. More specifically, the plug ground contact 530G according to the present embodiment has the width which is equal to or more than twice of the width of the ground contact of the USB 2.0 plug. Thus formed plug ground contact 530G is provided so as to cover a position where the ground contact of the USB 2.0 plug is provided. According to the present embodiment, a part of the plug ground contact 530G functions as the aforementioned plug contact portion. In other words, the plug contact portion according to the present embodiment is a part of the plug ground contact 530G.

Figure 2:
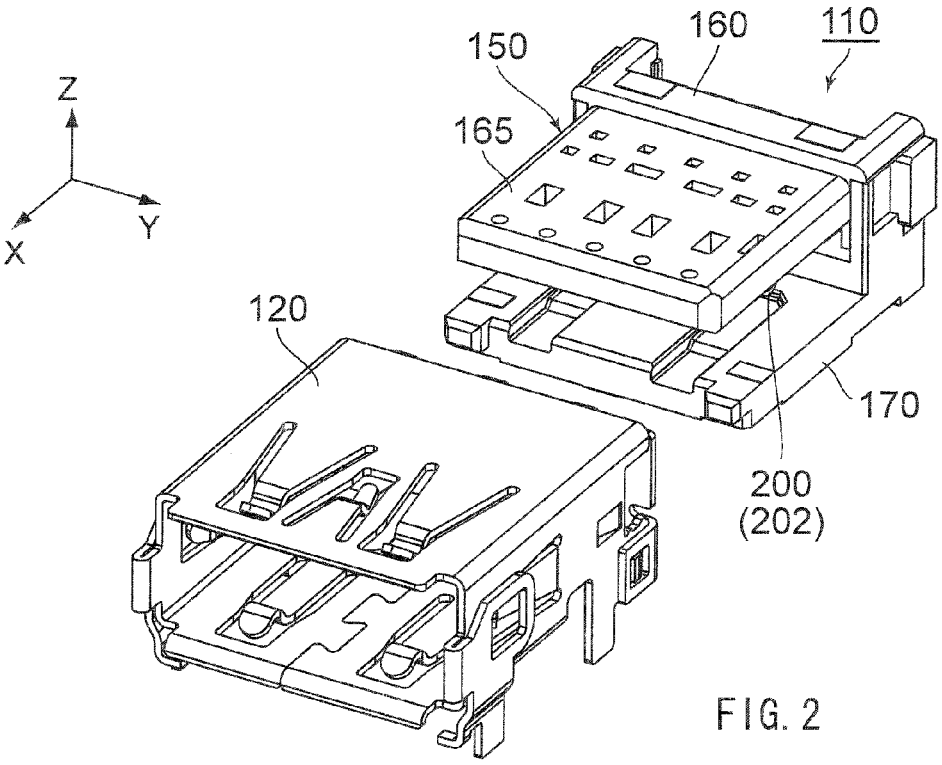
FIG. 2 is a perspective view showing a shell and a connector body of the USB receptacle of FIG. 1.
Figure 3:
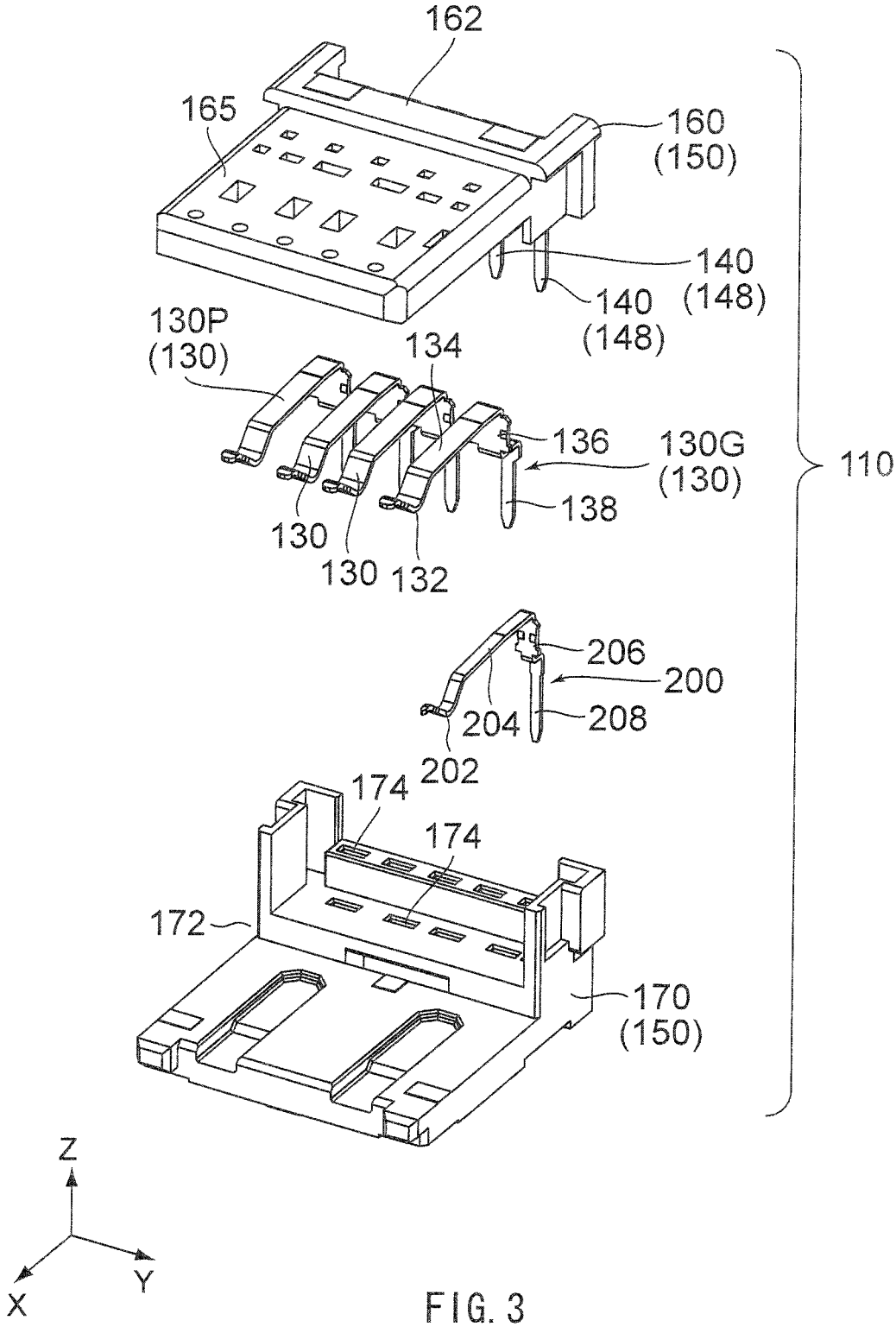
FIG. 3 is a partially exploded, perspective view showing the connector body of FIG. 2.

Referring to FIGS. 1 and 2, the USB receptacle 100 according to the present embodiment is formed by installing a detector 200 in a USB 3.0 receptacle having a structure compliant with the USB 3.0 standard. In other words, the USB receptacle 100 is a modification of the USB 3.0 receptacle. However, the USB receptacle 100 may be a modification of a standard USB receptacle (i.e. a USB receptacle compliant with the USB standard) other than the USB 3.0 receptacle. For example, the USB receptacle 100 may be a modification of a USB 2.0 receptacle (i.e. a standard USB receptacle) having a structure compliant with the USB 2.0 standard. The USB receptacle 100 according to the present embodiment has a connector body 110 and a shell 120 made of a metal. The shell 120 encloses the connector body 110 in the YZ-plane perpendicular to the X-direction. As shown in FIG. 3, the connector body 110 has a plurality of contacts 130 each made of a conductive material, a plurality of additional contacts 140 each made of a conductive material, a holding member 150 made of an insulating material and the detector 200 made of a conductive material. The contacts 130 are compliant with the USB 2.0 standard while the additional contacts 140 are compliant with the USB 3.0 standard.

Figure 4:
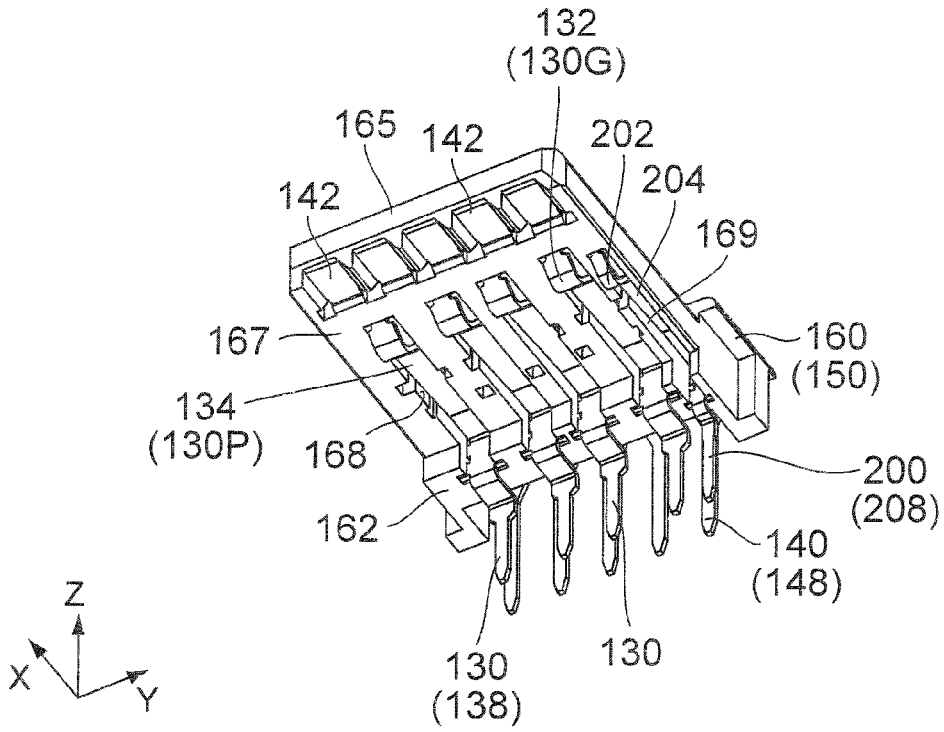
FIG. 4 is a perspective view showing the connector body of FIG. 2, wherein a second member of the connector body is not illustrated.

As shown in FIG. 3, the holding member 150 according to the present embodiment is comprised of a first member 160 and a second member 170. The first member 160 is mainly used for holding the contacts 130, the additional contacts 140 and the detector 200. The second member 170 is mainly used for positioning the contacts 130, the additional contacts 140 and the detector 200. The first member 160 has a fixing portion 162 and a plate portion 165 formed with a principal surface (lower surface) 167. The fixing portion 162 has a rectangular parallelepiped block shape. The fixing portion 162 constitutes a rear side (i.e. the negative X-side) of the first member 160. The plate portion 165 extends forward (i.e. along the positive X-direction) from the fixing portion 162. As shown in FIG. 4, the principal surface 167 of the plate portion 165 is formed with a plurality of accommodation ditches 168 and one accommodation ditch 169. The accommodation ditch 168 and the accommodation ditch 169 accommodate a part of the contact 130 and a part of the detector 200, respectively. As shown in FIG. 3, the second member 170 has a positioner 172 at a rear end thereof, The positioner 172 is formed with a plurality of positioning holes 174 piercing the second member 170 in the Z-direction (i.e. upper-to-lower direction which is the vertical direction). The positioner 172 arranges and holds the contacts 130, the additional contacts 140 and the detector 200 in the positioning holes 174.

As can be seen from FIGS. 3 and 4, the additional contacts 140 are embedded in the first member 160 by insert-molding when the first member 160 is formed. The additional contact 140 has a contact point 142 and a terminal portion 148. The contact point 142 of the additional contact 140 is exposed at a front end side (i.e. the positive X-side end) of the principal surface 167 of the plate portion 165. The terminal portion 148 of the additional contact 140 extends downward (i.e. along the negative Z-direction) from a rear end side (i.e. the negative X-side end) of the first member 160.

The contacts 130 and the detector 200 are press-fitted in the first member 160 after the first member 160 is formed. As shown in FIG. 3, the contacts 130 include a ground contact 130G and a power contact 130P. Each of the contacts 130 has a contact point 132, a spring portion 134, a fixed portion 136 and a terminal portion 138. The spring portion 134 has a resiliency so that the contact point 132 is resiliently supported by the spring portion 134. The fixed portion 136 is press-fitted in and fixed by the fixing portion 162 of the first member 160 so that the first member 160 holds the contact 130. As shown in FIG. 3, the detector 200 is configured similar to the contact 130. More specifically, the detector 200 has a detecting portion (contact portion) 202, a spring portion 204, a fixed portion 206 and a terminal portion 208. The spring portion 204 has a resiliency so that the detecting portion 202 is resiliently supported by the spring portion 204. The fixed portion 206 is press-fitted in and fixed by the fixing portion 162 of the first member 160 so that the first member 160 holds the detector 200.

As shown in FIG. 4, the contacts 130 and the detector 200 are held by the first member 160 (i.e. holding member 150) so as to be arranged in the Y-direction (width direction). The terminal portions 138 and the terminal portion 208 extend downward (i.e. along the negative Z-direction) from the rear end side (i.e. the negative X-side end) of the first member 160. As can be seen from FIG. 3, the terminals, which include the terminal portions 138, the terminal portions 208 and the terminal portions 148 of the additional contacts 140, are inserted in the positioner 172 of the second member 170. In detail, the aforementioned terminals are inserted in the positioning holes 174 provided in the positioner 172, respectively, so as to be arranged in the XY-plane.

Referring to FIG. 4, the spring portion 134 and the spring portion 204 are accommodated in the accommodation ditch 168 and the accommodation ditch 169, respectively. The spring portion 134 and the spring portion 204 are resiliently deformable and movable in the accommodation ditch 168 and the accommodation ditch 169, respectively. Accordingly, the contact point 132 supported by the spring portion 134 and the detecting portion 202 supported by the spring portion 204 are movable mainly in the upper-to-lower direction (Z-direction).

As shown in FIG. 4, the holding member 150 arranges and holds the contacts 130 in the width direction (Y-direction) so that the contact points 132 of the contacts 130 project from the principal surface 167 of the plate portion 165. Similarly, the holding member 150 holds the detector 200 so that the detecting portion 202 projects from the principal surface 167 of the plate portion 165. According to the present embodiment, the contact points 132 and the detecting portion 202 project downward (i.e. in the negative Z-direction) from the principal surface 167 under an initial state (i.e. unmated state) where the USB receptacle 100 and the USB plug are not mated with each other. The contact points 132 and the detecting portion 202 project in the same direction.

According to the present embodiment, a width (i.e. a size in the Y-direction) of the detector 200 is smaller than a width of the contact 130. In detail, a width of the detecting portion 202 of the detector 200 is equal to or smaller than half of a width of the contact point 132 of the contact 130. Furthermore, a width of the spring portion 204 is equal to or smaller than half of a width of the spring portion 134. In other words, the detector 200 according to the present embodiment is slenderer than the contact 130.

The detector 200 according to the present embodiment is provided outward in the Y-direction of the ground contact 130G of the contacts 130. In other words, the detector 200 is provided at a position which is nearer to the ground contact 130G than the contacts 130 other than the ground contact 130G. Accordingly, a distance between the detecting portion 202 and the contact point 132 of the ground contact 130G is smaller than a distance between the detecting portion 202 and the contact point 132 of the contact 130 other than the ground contact 130G.

Figure 7:
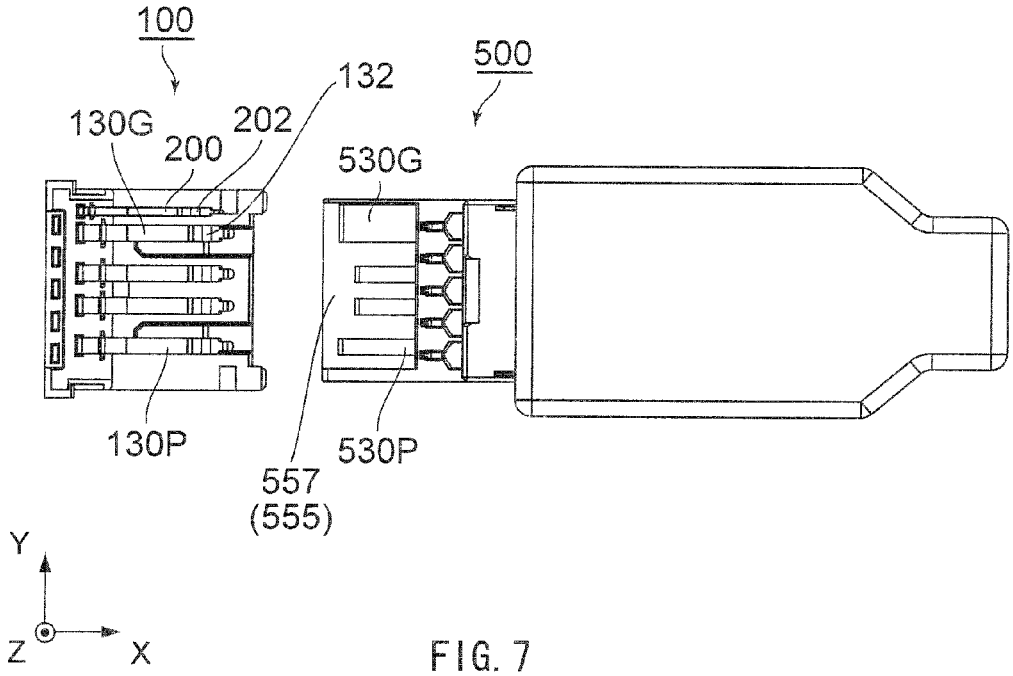
FIG. 7 is a top view showing the USB receptacle of FIG. 1 and the special USB plug of FIG. 5, wherein a shell, a first member and an additional contact of the USB receptacle, and the shell of the special USB plug are not illustrated.

As shown in FIG. 7, according to the present embodiment, a distance between an outside edge (i.e. the positive Y-side edge) of the detector 200 in the Y-direction and an inside edge (i.e. the negative Y-side edge) of the ground contact 130G in the Y-direction is equal to or smaller than a size (i.e. a predetermined width) of the plug ground contact 530G in the Y-direction. Accordingly, the plug ground contact 530G is connectable to both the ground contact 130G and the detector 200 under a mated state where the USB receptacle 100 is mated with the special USB plug 500. According to the present embodiment, a predetermined part of the plug ground contact 530G is brought into contact with the detector 200 under the mated state. The plug contact portion according to the present embodiment is the aforementioned predetermined part of the plug ground contact 530G. In other words, the detector 200 is positioned so as to be brought into contact with the plug contact portion (i.e. apart of the plug ground contact 530G) under the mated state.

As can be seen from FIGS. 4 and 7, the detecting portion 202 of the detector 200 is located rearward of the contact point 132 of the ground contact 130G. Accordingly, when the USB receptacle 100 is transferred to the mated state from the unmated state, the detector 200 is connected to the plug ground contact 530G after the ground contact 130G is connected to the plug ground contact 530G. As can be seen from the above description, the plug contact portion of the special USB plug 500 and the detecting portion 202 of the detector 200 are brought into contact and electrically connected with each other under the mated state.

As can be seen from FIG. 7, the standard USB plug (not shown) has no portion which is configured to be electrically connected to the detecting portion 202 of the detector 200. When the standard USB plug is mated with the USB receptacle 100 according to the present embodiment, the detecting portion 202 of the detector 200 is brought into contact with an insulated plate portion of a holding member of the standard USB plug. Accordingly, the detector 200 is not electrically connected to the standard USB plug. As can be seen from the above description, it is possible to judge whether the USB plug mated with the USB receptacle 100 is the special USB plug 500 or the standard USB plug by monitoring whether the detector 200 is electrically connected to the plug ground contact 530G or not. In other words, it is possible to identify (i.e. detect) the type of the mated USB plug.

By using the USB receptacle 100, the special USB plug 500 and the standard USB plug (not shown) configured as described above, it is possible to control an electrical power supplied to a device by the USB receptacle 100 depending on an electrical power which is necessary to the device. For example, a device which is workable by a normal (i.e. relatively small) power supply may be connected to the standard USB plug while a device such as an external hard disk device which needs a large power supply may be connected to the special USB plug 500. More specifically, when the special USB plug 500 is inserted into the USB receptacle 100, the large power (i.e. a first electric power) may be transmitted by using the power contact 130P and the ground contact 130G of the USB receptacle 100. On the contrary, when the standard USB plug is inserted into the USB receptacle 100, the relatively small, normal power (i.e. a second electric power) may be transmitted by using the power contact 130P and the ground contact 130G of the USB receptacle 100. In other words, the USB connector may transmit the first electric power larger than the second electric power to the special USB plug 500 by using the power contact 130P and the ground contact 130G when detecting by the detector 200 that the USB receptacle 100 is mated with the special USB plug 500. The USB connector may transmit the second electric power to the standard USB plug when the USB receptacle 100 is mated with the standard USB plug.

According to the aforementioned embodiment, the USB receptacle 100 and the special USB plug 500 are based on the USB 3.0 standard. However, the USB receptacle 100 and the special USB plug 500 may be based on the other USB standard, For example, the USB receptacle 100 and the special USB plug 500 may be based on the USB 2.0 standard. Moreover, one of the USB receptacle 100 and the special USB plug 500 may be based on the USB 2.0 standard while the other one may be based on the USB 3.0 standard.

The holding member 150 of the USB receptacle 100 according to the aforementioned embodiment is made by combining the first member 160 and the second member 170 which are formed separately from each other. However, the first member 160 and the second member 170 may be formed integrally in advance. Moreover, only the positioner 172 may be separated from the holding member 150.

According to the aforementioned embodiment, the contacts 130 and the detector 200 of the USB receptacle 100 are press-fitted in the first member 160 while the additional contacts 140 are embedded in the first member 160 by insert-molding. However, the contact 130, the detector 200 and the additional contact 140 may be attached to the first member 160 by different method.

The USB receptacle 100 according to the aforementioned embodiment has the one detector 200. However, the USB receptacle 100 may have a plurality of the detectors 200, provided that the USB receptacle 100 has a sufficient space.

Moreover, the USB receptacle 100 according to the aforementioned embodiment is a reverse type receptacle. However, the USB receptacle 100 may be a normal type receptacle.

The present application is based on a Japanese patent applications of JP2012-043534 filed before the Japan Patent Office on Feb. 29, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A universal serial bus (USB) connector comprising:

a special USB plug having a plug ground contact and a plug contact portion which is not provided in a standard USB plug compliant with a USB standard, the plug ground contact having a width wider than another width compliant with a 2.0 version of the USB standard, the plug contact portion being a part of the plug ground contact; and a USB receptacle selectively mateable with and removable from the standard USB plug and the special USB plug along a predetermined direction, the USB receptacle having a plurality of contacts compliant with the 2.0 version of the USB standard, a detector and a holding member, the contacts including a ground contact which is connected to the plug ground contact under a mated state where the USB receptacle is mated with the special USB plug, each of the contacts having a contact point, the detector having a detecting portion which is brought into contact with the plug contact portion under the mated state, the holding member having a plate portion formed with a principal surface, the holding member arranging and holding the contacts in a width direction perpendicular to the predetermined direction so that the contact point of the contact projects from the principal surface of the plate portion, the holding member holding the detector so that the detecting portion projects from the principal surface of the plate portion, a distance between the detecting portion and the contact point of the ground contact being smaller than a distance between the detecting portion and the contact point of the contact other than the ground contact.

2. The USB connector as recited in claim 1, wherein the holding member holds the contacts and the detector so as to arrange the contacts and the detector in the width direction.

3. The USB connector as recited in claim 1, wherein:

the contacts include a power contact and the ground contact; and the USB connector transmit a first electric power to the special USB plug by using the power contact and the ground contact when a mating of the USB receptacle with the special USB plug is detected by the detector, the USB connector transmitting a second electric power to the standard USB plug when the USB receptacle is mated with the standard USB plug, the first electric power being larger than the second electric power.

4. The USB connector as recited in claim 1, wherein a width of the detector is smaller than a width of the contact.

5. The USB connector as recited in claim 1, wherein:

the USB receptacle further has a plurality of additional contacts compliant with a 3.0 version of the USB standard; and the holding member holds the additional contacts.

* * * * *